US008241434B2

(12) United States Patent
Walkden

(10) Patent No.: US 8,241,434 B2
(45) Date of Patent: Aug. 14, 2012

(54) DISHWASHER WITH HIGH VOLTAGE DC MOTOR

(75) Inventor: Thomas George Walkden, Stratford, CT (US)

(73) Assignee: Johnson Electric S.A., La Chaux-de-Fonds (CH)

( * ) Notice: Subject to any disclaimer, the term of this patent is extended or adjusted under 35 U.S.C. 154(b) by 1667 days.

(21) Appl. No.: 11/337,588

(22) Filed: Jan. 24, 2006

(65) Prior Publication Data

US 2006/0162744 A1 Jul. 27, 2006

Related U.S. Application Data

(60) Provisional application No. 60/646,536, filed on Jan. 25, 2005.

(51) Int. Cl.
*B08B 3/00* (2006.01)

(52) U.S. Cl. ..... 134/56 D; 134/57 D; 134/58 D

(58) Field of Classification Search ..... 134/56 R, 134/56 D, 57 R, 57 D, 58 R, 58 D, 8; 417/423.7, 417/423.14, 266, 372, 51
See application file for complete search history.

(56) References Cited

U.S. PATENT DOCUMENTS

| | | | | |
|---|---|---|---|---|
| 1,511,661 | A * | 10/1924 | Dantzebecher | 134/109 |
| 3,083,310 | A * | 3/1963 | Tweedy et al. | 310/154.18 |
| 3,518,522 | A * | 6/1970 | Wagoner et al. | 388/838 |
| 4,220,901 | A * | 9/1980 | Dummer | 388/838 |
| 4,829,254 | A * | 5/1989 | Baines | 324/167 |
| 6,710,484 | B2 * | 3/2004 | Kitoh et al. | 310/83 |
| 2002/0030415 | A1 * | 3/2002 | Morooka et al. | 310/68 R |
| 2002/0108638 | A1 * | 8/2002 | Bigott | 134/18 |
| 2003/0024864 | A1 * | 2/2003 | Hegeman et al. | 210/167 |
| 2004/0079400 | A1 * | 4/2004 | Young | 134/57 D |

FOREIGN PATENT DOCUMENTS

| | | | |
|---|---|---|---|
| EP | 0635927 | * | 7/1994 |
| EP | 0732438 | * | 8/1995 |
| EP | 0732438 | * | 9/1996 |
| FR | 2568377 | * | 1/1986 |
| GB | 2095918 | * | 10/1982 |
| JP | 10-290772 | * | 11/1998 |
| JP | 2003-190070 | * | 7/2003 |
| WO | WO 2004044434 | * | 5/2004 |

OTHER PUBLICATIONS

Reston Condit; Brushed DC motor fundamentals; Jan. 26, 2004, Microchip.*
John Wiley & Son, 2001, Section 9.5 Electric Motor.*

* cited by examiner

*Primary Examiner* — Michael Kornakov
*Assistant Examiner* — Eric Golightly
(74) *Attorney, Agent, or Firm* — Birch, Stewart, Kolasch & Birch, LLP

(57) ABSTRACT

A dishwasher which uses a high voltage DC motor to drive a pump. The dishwasher cleans dishes and cooking and eating utensils by the use of a high pressure water spray driven by an electric pump which circulates water. The DC motor may have a built in motor controller to allow the motor to have a soft start, multiple speeds, smooth ramping between speeds and load control. This allows for an energy efficient system and noise prevention.

16 Claims, 4 Drawing Sheets

DISHWASHER WITH HIGH VOLTAGE DC MOTOR

CROSS-REFERENCE TO RELATED APPLICATIONS

The present application claims priority from provisional U.S. Application 60/646,536, filed Jan. 25, 2005, which is hereby incorporated by reference. This provisional patent application claims no priority.

BACKGROUND OF THE INVENTION

1. Field of the Invention

The present invention generally relates to dishwashers with pumps driven by electric motors and more specifically to dishwashers having pumps driven by high voltage DC motors.

2. Description Of The Background

Dishwashers have become a common household appliance. As is well known, implements and utensils used for cooking and eating may be placed inside a special waterproof cabinet so that hot soapy water can be sprayed under high, but controlled, pressure to remove food particles, grease, and other debris from the items placed in the dishwasher. The items then become clean so that they may be reused.

Such dishwashers normally include a pump to provide the water spray with a controlled pressure. The water is recirculated by using a coarse filter system. The pumps are normally driven by an electric motor. Currently, most dishwashers use an induction motor, such as a permanent split capacitor motor, to drive the pump, because this type of motor has a reliable construction.

While this type of induction motor has been commonly used for many years, there remain some disadvantages to such a motor. First, in view of high energy costs, the efficiency of the motor is an important consideration. This is especially true as dishwashers are used more extensively. Another disadvantage of the induction motor is the audible noise created. Consumers prefer that the dishwasher create as little noise as possible, especially when the dishwasher is run at night.

SUMMARY OF THE INVENTION

Thus, the present invention provides a dishwasher having a high voltage DC motor in order to avoid the disadvantages of prior art motors.

The present invention provides an energy efficient dishwasher.

The present invention further provides a dishwasher which has low audible noise.

Furthermore, the present invention provides a high efficiency dishwasher having low audible noise.

The present invention further provides a dishwasher having a high voltage permanent magnet direct current motor for driving a main water circulation pump.

The present invention still further provides a dishwasher with a high voltage permanent magnet direct current motor which is energy efficient and has low noise.

These and other advantages are obtained by providing a dishwasher using a high voltage permanent magnet direct current motor for driving a main water circulation pump.

DETAILED DESCRIPTION OF THE PREFERRED EMBODIMENTS

Figure 1:
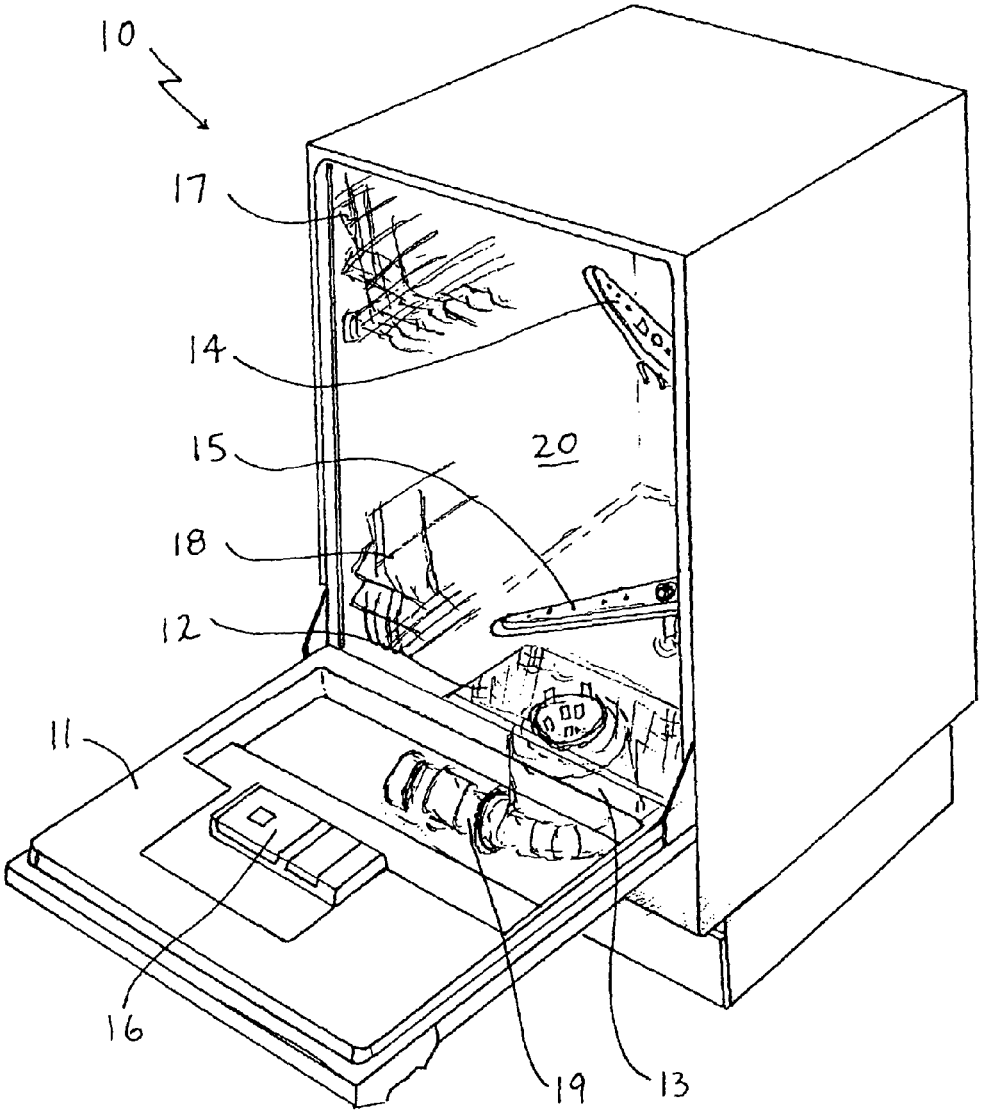
FIG. 1 is a view of a dishwasher according to the present invention.

FIG. 1 illustrates a dishwasher 10 with a front door 11 open to view various interior features such as the filter 12, the sump 13, water wands, 14, 15 detergent dispenser 16 and wire racks 17, 18 (only partially shown to give a general impression.) The operation of the dishwasher is of a standard technique and will not be described in detail except to explain that water entering the sump is coarsely filtered by the filter and repeatedly sprayed through the water wands onto dishes and other objects to clean them.

Shown in hidden outline is the body of the sump 13 in which the water collects after being filtered and an electric pump 19 for circulating the water within the dishwasher from the sump 13 to the wands 14, 15. Also provided but not shown are water fittings, drainage system which may include a separate drain pump, electrical supply and a controller for controlling operation and timing of the function performed by the dishwasher.

The sump 13 is similar to a bowl for collecting the water from the inside of the washing cavity 20 and has an outlet connected to an inlet of the pump 19. The pump 19 has an impeller driven within a pump chamber by an electric motor. The pump may include a macerator for reducing the size of large food particles.

Figure 2:
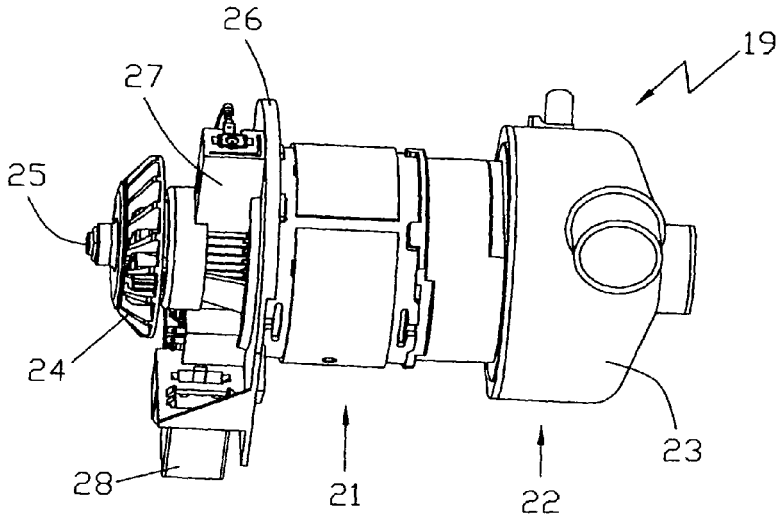
FIG. 2 is a perspective view of a motor for the dishwasher of FIG. 1.

FIG. 2 shows a first embodiment of the electric pump 19 used in the dishwasher 10. The pump includes a pump section 22 driven by an electric motor 21. FIG. 2 does not show the fan cover which has been removed. The motor is a single speed, high voltage permanent magnet direct current (HVDC) motor. The motor has a 2-pole permanent magnet stator and a 24 pole wound rotor. The motor has a single speed preferably operating at 3600 rpm or higher and being connected to the mains electrical supply through a rectifier circuit, but without a transformer. Thus, the motor voltage is 120 volts DC when used in a U.S. domestic dishwasher. Preferably, the motor has an expected life of 5,000 hours of operation. The motor has an efficiency of more than 65% and preferably 70% or more.

It would also be possible that the single speed motor of the first embodiment shown in FIG. 2 could be operated in the two speed mode by selectively supplying current to the motor through a half bridge rectifier or a full wave rectifier.

The motor is shown attached to the pump section 22, although only the pump cover 23 is clearly visible. The other end of the motor is normally closed by a fan cover which is removed in FIG. 2 to show a cooling fan 24 attached to an end of the motor shaft 25. Also visible is a motor end bracket or end cap 26 supporting a shaft bearing (not visible), brush gear 27 in the form of a pair of cage brushes and a motor terminal connector 28 for connecting the motor to an electrical power source. A second end bracket or end cap 29 is located at the opposite end of the motor and supports a second bearing for the motor shaft. This end cap also forms part of the pump section, dividing the pump chamber from the motor and supports seals for preventing water entering the motor along the motor shaft.

Figure 3:
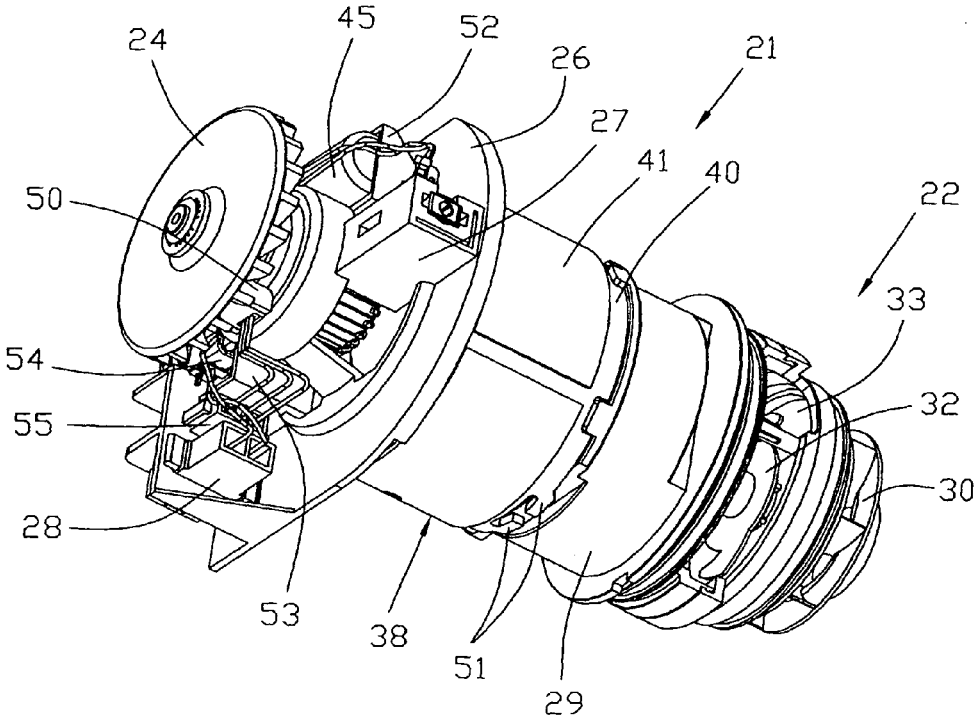
FIG. 3 is a view of an alternative motor for the dishwasher of FIG. 1.
Figure 4:
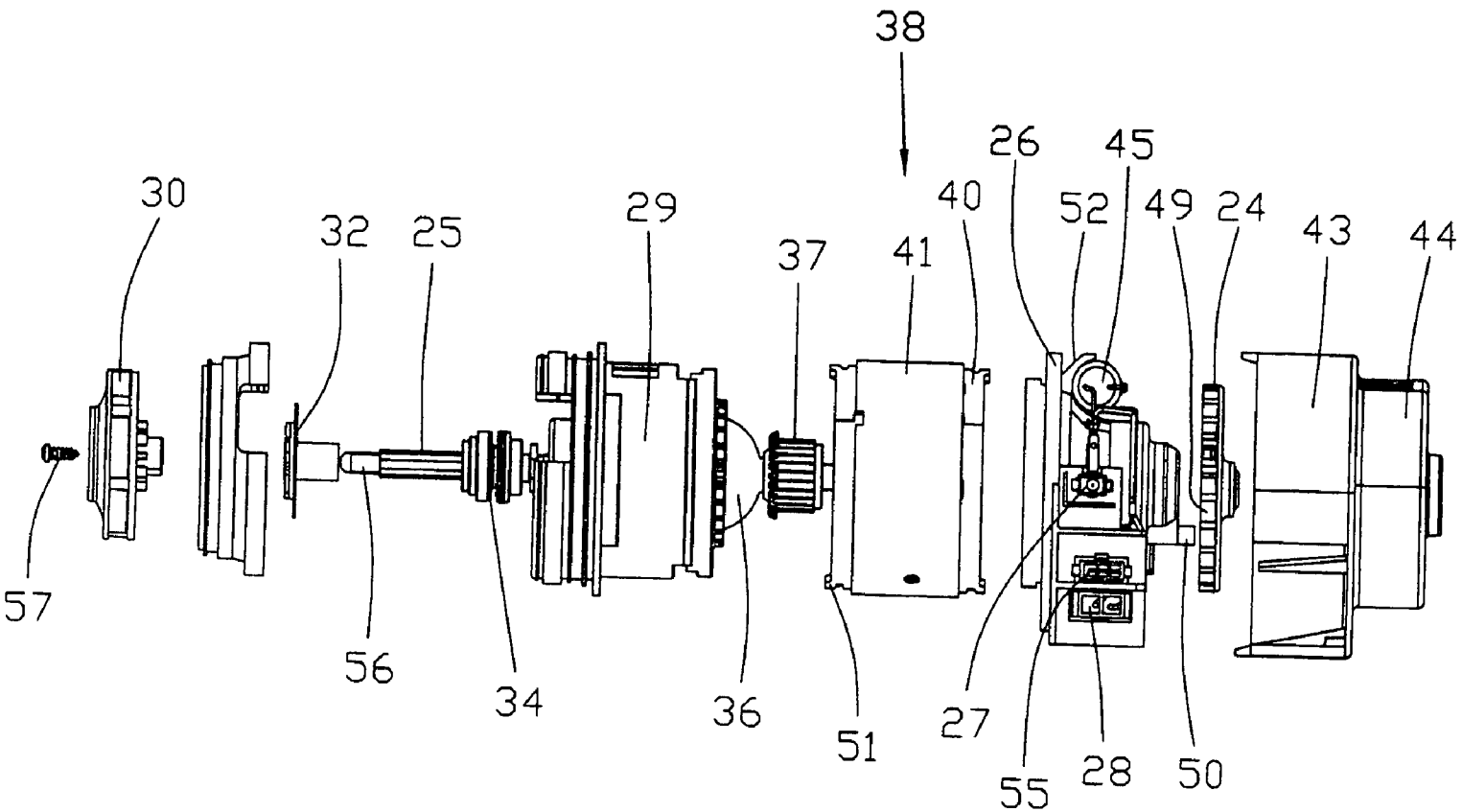
FIG. 4 is an exploded view of the motor of FIG. 3.
Figure 5:
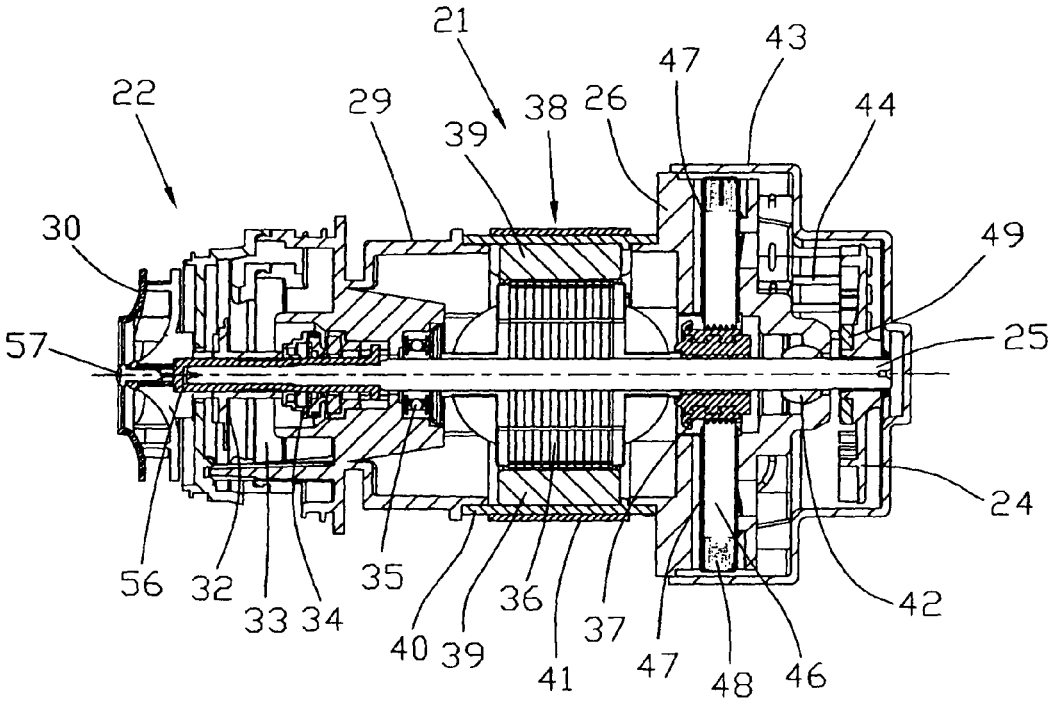
FIG. 5 is a sectional view of the motor of FIG. 3.

The second embodiment of the motor of the present invention is shown in FIGS. 3, 4 and 5. The construction of the pump and motor is similar to that of FIG. 2 with the exception that the first end bracket 26 includes a receptacle 52 for the smoothing capacitor 45, a recess 53 for a thermal cut out switch and a compartment 54 for a full wave bridge rectifier. By using this arrangement, the motor can be connected to a standard AC electrical current which is then converted to DC current by way of the bridge rectifier which is part of the motor section. Thus, the motor can be used with no change to the control module in the dishwasher when it replaces an AC motor. Of course, it would also be possible to modify the dishwasher controller to provide the required DC power to operate in the desired fashion.

FIG. 3 is a perspective view of the electric pump with the motor fan cover removed and with the pump cover removed. FIG. 4 is an exploded view and FIG. 5 is a sectional view of the pump of FIG. 3 with the pump cover removed. Details of the construction of the motor and pump section will now be described. The motor 21 is shown with a pump impeller 30 attached to the motor shaft 25. Adjacent the impeller 30 is part of the pump chamber forming a backing for the impeller 30 and the impeller volute (not shown). The pump cover 23 also houses the macerator 32 which is a metal disc with two integral radially extending blades which rotate with the shaft 25 within a separate chamber 33 in the pump section 22. Any large food particles which flow into the macerator chamber will be hit by the rotating blades and broken up into small pieces. This prevents larger food particles from clogging the drain pump at the end of the wash cycle.

Adjacent the macerator and forming a wall of the pump chamber is the second end cap 29 of the motor. The motor shaft 25 passes through the end cap 29 with a seal assembly 34 disposed between the shaft 25 and the end cap 29 to keep water and other liquids out of the motor. The end cap 29 also supports a bearing 35 for the motor shaft 25.

Next along the shaft 25 is a wound rotor assembly 36. The rotor assembly comprises a rotor core of laminated steel construction and a commutator 37, both mounted on the shaft. Rotor windings are wound around poles of the rotor core and terminated on the commutator. The rotor has 24 poles. The rotor assembly is located in working association with a stator 38 comprising two arcuate ceramic permanent magnets 39 fitted to the inside of a metal ring or housing 40. Around the housing is a second ring of steel known as a keeper ring or flux ring 41.

At the other end of the housing is the first end cap 26 closing off the housing 40 and supporting the other bearing 42 for the shaft 25. The shaft 25 extends through the end cap 26 and the fan 24 is attached to the end of the shaft 25 to provide a flow of air within the motor to cool it. A cover 43, not shown in FIG. 3, is also provided to protect the fan and has vents 44 for the flow of the cooling air. The end cap 26 also supports the brush gear 27 and motor terminations 28. The motor terminations may be lead wires but preferably, as shown, the terminations are terminals 28. The terminals may be connected directly to the brush gear 27 or via a noise suppression component such as a capacitor 45.

The brush gear comprises two cage brushes 46. The brushes are of the sintered graphite construction with an embedded shunt and may slide directly in passageways formed in the end cap 26 or the passageways may have a metal, preferably brass, liner 47. Springs 48, either coil type or torsion type, urge the brushes 46 into sliding contact with the commutator 37. The contact face of the brushes 46 preferably have a plurality of ridges so as to contact the commutator 37 at a plurality of points to ensure good contact between the commutator 37 and the brush 46. The commutator surface is preferably polished to provide a smooth rubbing surface between the brush and the commutator to reduce audible noise created by the brushes sliding over the commutator surface.

A speed or position sensor may be provided by adding a small ring magnet 49 rotating with the shaft and locating a sensor, such as a Hall sensor 50, in association with the ring magnet 49 to sense changes in the magnetic field of the ring magnet 49 as the shaft 25 turns. The output signals of magnetic sensors, especially Hall sensors, can be considered as a binary signal. A twelve pole output signal means that the sensor magnet has twelve poles (six pairs of M-S poles), thus producing six or twelve pulses per revolution, depending on the sensor type. The greater the number of poles, the better the resolution of the position or speed sensor.

Although a Hall sensor feedback device is used in this embodiment, other feedback devices, such as an optical sensor may be used instead to provide a speed signal to the motor controller.

The end caps 26, 29 are connected to the stator 38 by locking fingers 51 formed integrally with the stator housing 40, being bent or otherwise deformed over ridges or projections or steps on the end caps to hold the end caps in place. The fingers preferably extend in a circumferential direction of the stator housing 40. Flanges 52 or stops on the end caps 26, 29 allow the end caps to be inserted into the stator housing 40 to a predetermined axial depth. In addition or in place of the locking fingers, screws may be provided which extend through the stator from one end cap to the other to securely clamp the end caps to the stator. The screws would pass through the circumferential gaps between the two magnets 39.

To reduce exposure of the motor shaft to chemical erosion by the washing chemicals, the motor shaft 25 may include a plastics material cover 56 where the shaft extends within the pump section 22, covering the shaft from the seal assembly 34 to the impeller and the cover 56 has a molded feature to securely key the impeller 30 to the shaft cover 56. A screw 57 may be used to secure the impeller 30 to the shaft cover 56 as well or instead of the molded feature of the cover.

Also, it can be seen that the motor has a separate socket or set of three terminals 55 which are connected to the speed sensor. The speed sensor is located on the end of the bearing bracket of the first end cap 26, tucked in underneath the fan 24. By fitting the magnet to the fan, no additional space is required since it is located in a dead space. It also reduces the number of items to be attached to the shaft. The ring magnet 49 may be fitted to the shaft directly underneath the fan 24 or as a part of the fan 24. In the cross-section shown in FIG. 5, the ring magnet 49 can be seen fixed to an inner surface of the fan 24, radially inward of the fan blades, therefore effectively not occupying any additional space within the motor. The speed sensor provides feedback to the motor controller allowing the speed of the motor to be controlled.

Figure 6:
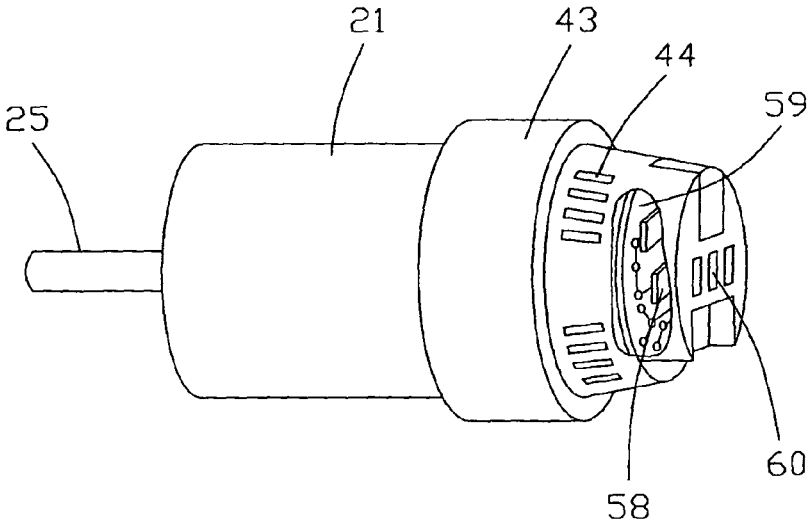
FIG. 6 is a view of a further alternative motor of the dishwasher of FIG. 1 showing a built-in controller.

The motor of FIG. 6, as an alternative to the motor of FIG. 2, is a HVDC motor having a controller 58 built-in and being designed to run at multiple speeds. For example, a simple variation would be a 2 speed motor operable at 2000 rpm and 4000 rpm. The controller 58 would receive signals, either in digital or analog form, from the dishwasher controller to operate at a particular speed. The motor controller then supplies power to the motor to operate the motor at the desired speed. Such control mechanisms allow for the incorporation of special features such as a soft start and smooth change between speeds as well as controlled stopping of the motor. Controlled ramp up of the speed is appreciated to avoid sudden surges in water pressures. Other features which would be possible with the built in controller is a load variable speed control and optional speed/load setting for optimal efficiency and/or noise control. In the motor of FIG. 6 which is shown in schematic form for simplicity of description, the fan cover 43 has been partially sectioned to show the printed circuit board (PCB) 59 of the motor controller 58. The fan cover has a plurality of ventilation slots 44 for motor cooling around the periphery of the fan cover 47 and ventilation slots 60 on the end of the cover providing passage of air for cooling of the PCB 59 and its components, thus providing two cooling air flow paths through the fan cover. The two cooling air flow paths may not be completely separate although the PCB 59 can be arranged inside the cover so as to divide the air flow.

By using a high voltage DC motor, the energy utilization of the dishwasher is improved. The water circulation pump is the main power consumer of the dishwasher. The PSC motor runs at an efficiency of between 55% to 65% whereas the high voltage DC motor runs at an efficiency of between 65% to 85%. The speed of the motor can be optimized for maximum performance and is not dependent on the frequency of the supply power. The HVDC motor has four to five times higher starting torque and higher torque at lower speeds, meaning that starting can be easier and due to the controller, can be controlled easily to provide a soft start up and smooth ramp up/ramp down between operating speeds to avoid high surge currents.

The high starting torque of the HVDC motor is well appreciated for dishwashers which have a fairly high static friction caused by the water seals on the pump shaft and due to the pumps being started under full load. Also, the pumps may be partially blocked by sludge if the machines have not been used for an extended period of time, especially when they have not been properly emptied after the last use.

The HVDC motor also provides a quieter dishwasher. Firstly, it does not suffer from the 50/60 Hertz hum which plagues induction motors and which is particularly offensive to normal human hearing. This is appreciated by many users and leads to, at least the perception, of a quieter appliance.

The audible noise of the dishwasher increases with the speed of the pump motor. By having greater controllability over the speed of the pump, an even quieter operating mode can be achieved by operating the pump at a lower speed. The cleaning effect can be maintained by operating longer.

The HVDC motor also can be made significantly smaller than an equivalent induction motor with the same output power resulting in a smaller, lighter and thus, easier to handle pump/motor unit.

The desire for a variable speed comes from the desire for a variable pressure water supply. Varying the speed of the pump is an easy way to achieve this. With a single pump pressure, the cleaning effect is a compromise between delicate objects which can be damaged by high pressure and cooking utensils which require a high pressure to be cleaned properly. The result is often broken delicate crockery and unclean pots and pans. With a variable speed pump, different washing programs can be chosen allowing fine delicate china or even crystal to be cleaned by the same dishwasher that can effectively clean the toughest cooking pans. It also allows shorter cycles by using higher pump speeds and quieter modes by operating at slower pump speeds for longer. By controlling the acceleration as well as the speed, the rate of increase in water pressure can be controlled.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A dishwasher, comprising:

an outer housing;

a cavity within said outer housing for receiving items to be cleaned;

water sprays for spraying said items in said cavity;

a pump for circulating collected water to said sprays; and a high voltage brushed DC motor for driving said pump, wherein the motor includes a controller for controlling the speed of the motor, and wherein the controller provides a soft start and/or controlled acceleration.

2. The dishwasher according to claim 1, further comprising a sump for collecting water to be circulated and a filter for removing solid material from said circulated water.

3. The dishwasher according to claim 1, wherein the motor is a single speed, high voltage permanent magnet direct current motor.

4. The dishwasher according to claim 1, wherein the motor has a two pole permanent magnet stator and a 24 pole wound rotor.

5. The dishwasher according to claim 1, wherein the motor includes a plurality of cage brushes.

6. The dishwasher according to claim 1, wherein the motor includes a sensor for detecting speed or position.

7. The dishwasher according to claim 6, wherein the sensor is a Hall sensor.

8. The dishwasher according to claim 6, wherein the sensor is an optical sensor.

9. The dishwasher according to claim 6, wherein the sensor includes a ring magnet affixed to a cooling fan.

10. The dishwasher according to claim 6, wherein the sensor provides a twelve pole binary output signal.

11. The dishwasher according to claim 1, wherein the motor includes a rectifier for converting AC current to DC current.

12. The dishwasher according to claim 1, wherein the motor is a two speed motor.

13. The dishwasher according to claim 12, wherein the motor operates at 2000 rpm and 4000 rpm.

14. The dishwasher according to claim 12, wherein the motor selectively receives current through a half bridge rectifier or a full wave rectifier.

15. The dishwasher according to claim 1, wherein the motor includes a fan, a fan cover, and a plurality of ventilation slots in the fan cover.

16. The dishwasher according to claim 1, wherein the motor has an efficiency of 65%-85%.

* * * * *